US007959264B2

(12) United States Patent
Blair et al.

(10) Patent No.: US 7,959,264 B2
(45) Date of Patent: Jun. 14, 2011

(54) PRINT HEAD HAVING EXTENDED SURFACE ELEMENTS

(75) Inventors: Dustin W. Blair, San Diego, CA (US); Jeff Pollard, Corvallis, OR (US); Matthew D. Giere, San Diego, CA (US); Satya Prakash, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 244 days.

(21) Appl. No.: 12/260,326

(22) Filed: Oct. 29, 2008

(65) Prior Publication Data

US 2009/0051741 A1 Feb. 26, 2009

Related U.S. Application Data

(63) Continuation of application No. 11/154,000, filed on Jun. 16, 2005, now abandoned.

(51) Int. Cl.
*B41J 2/05* (2006.01)

(52) U.S. Cl. ..... 347/65; 347/63; 216/27

(58) Field of Classification Search ..... 347/63, 347/65, 5, 9; 216/27
See application file for complete search history.

(56) References Cited

U.S. PATENT DOCUMENTS

| | | | | |
|---|---|---|---|---|
| 5,387,314 | A * | 2/1995 | Baughman et al. | 216/27 |
| 6,007,176 | A | 12/1999 | Askren et al. | |
| 6,126,276 | A | 10/2000 | Davis et al. | |
| 6,254,214 | B1 | 7/2001 | Murthy et al. | |
| 6,280,013 | B1 | 8/2001 | Wade et al. | |
| 6,309,054 | B1 | 10/2001 | Kawamura et al. | |
| 6,607,259 | B2 | 8/2003 | Mott et al. | |
| 6,648,454 | B1 | 11/2003 | Donaldson et al. | |
| 6,746,106 | B1 | 6/2004 | Hager | |
| 2002/0060720 | A1 | 5/2002 | Kim et al. | |
| 2002/0084245 | A1 | 7/2002 | Hiroki et al. | |
| 2004/0085408 | A1 | 5/2004 | Donaldson et al. | |
| 2004/0218017 | A1 | 11/2004 | Kawamura et al. | |
| 2005/0036006 | A1 | 2/2005 | Watanabe | |

FOREIGN PATENT DOCUMENTS

JP 2002-361884 12/2002

* cited by examiner

*Primary Examiner* — Lam S Nguyen

(57) ABSTRACT

Embodiments include forming internal or external extended surface elements on a print-head substrate, at least in part, using a light beam.

7 Claims, 9 Drawing Sheets

PRINT HEAD HAVING EXTENDED SURFACE ELEMENTS

RELATED APPLICATION

This Application is a continuation of U.S. application Ser. No. 11/154,000, titled "PRINT HEAD HAVING EXTENDED SURFACE ELEMENTS," filed Jun. 16, 2005 now abandoned, which is commonly assigned and incorporated herein by reference.

BACKGROUND

Thermal ink-jet print heads usually include a print die, e.g., formed on a substrate of silicon or the like using semi-conductor processing methods, such as photolithography or the like. Print dies normally include resistors and an ink delivery channel that delivers the ink to the resistors so that the ink covers the resistors. Electrical signals are sent to the resistors for energizing the resistors. An energized resistor rapidly heats the ink that covers it, causing the ink to vaporize and be ejected through an orifice aligned with the resistor so as to print a dot of ink on a recording medium, such as a sheet of paper.

A portion of the heat dissipated by the resistors that does not go into vaporizing the ink is conducted through the substrate and is subsequently convected away by the ink flowing through the ink delivery channel. However, the print die can still overheat, causing the print head to stop printing.

DETAILED DESCRIPTION

In the following detailed description of the present embodiments, reference is made to the accompanying drawings that form a part hereof, and in which is shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
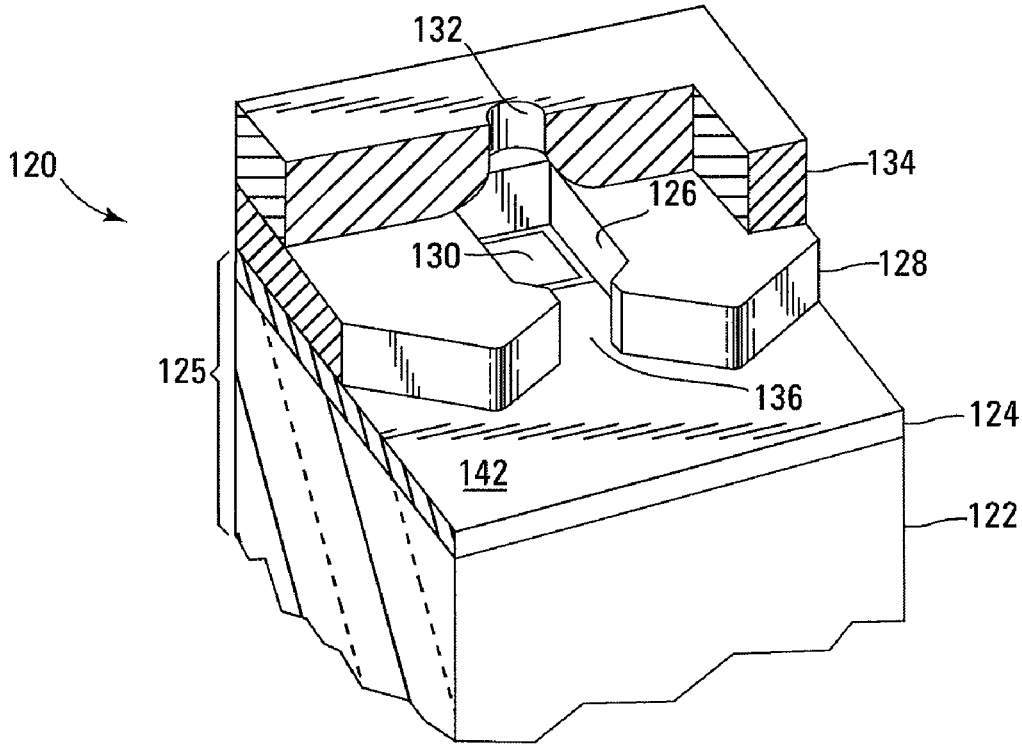
FIG. 1 is a perspective cutaway view of a portion of an embodiment of a print head, according to an embodiment of the disclosure.

FIG. 1 is a perspective cutaway view of a portion of a print head 120, showing components for ejecting ink, according to an embodiment. The components of print head 120 are formed on a wafer 122, e.g., of silicon, that includes a dielectric layer 124, such as a silicon dioxide layer. Hereafter, the term substrate (or print-head substrate) 125 will be considered as including at least a portion of wafer 122 and at least a portion of dielectric layer 124. A number of print head substrates may be formed simultaneously on a single wafer dies, each having an individual print head.

Ink droplets are ejected from chambers 126 formed in the substrate 125, and more specifically, formed in a barrier layer 128 that for one embodiment may be from photosensitive material that is laminated onto the print head substrate 125 and then exposed, developed, and cured in a configuration that defines chambers 126.

The primary mechanism for ejecting an ink droplet from a chamber 126 is a thin-film resistor 130. The resistor 130 is formed on the print head substrate 125. Resistor 130 is covered with suitable passivation and other layers, as is known in art, and connected to conductive layers that transmit current pulses for heating the resistors. One resistor is located in each of the chambers 126.

The ink droplets are ejected through orifices 132 (one of which is shown cut away in FIG. 1) formed in an orifice plate 134 that covers most of the print head. The orifice plate 134 may be made from a laser-ablated polyimide material. The orifice plate 134 is bonded to the barrier layer 128 and aligned so that each chamber 126 is continuous with one of the orifices 132 from which the ink droplets are ejected.

Figure 2:
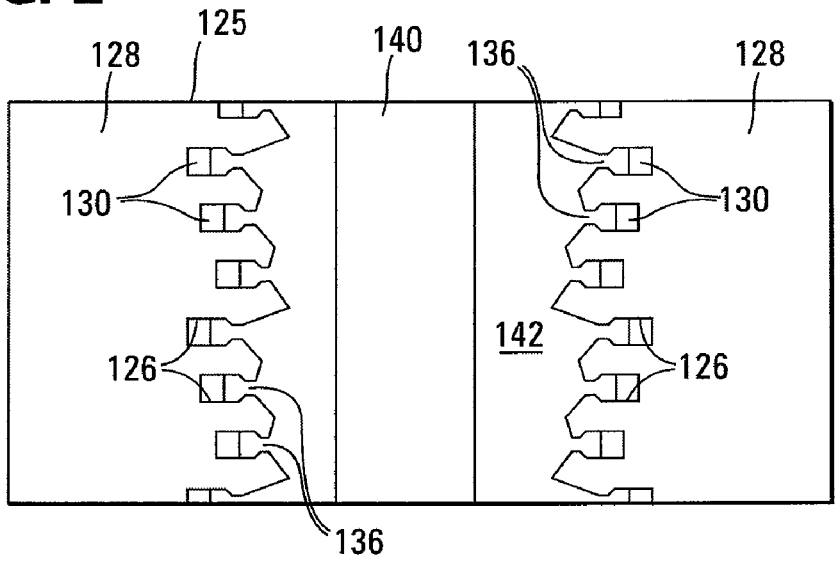
FIG. 2 is a top plan view of an embodiment of a print head substrate and ink ejecting components, according to an embodiment of the disclosure.

Chambers 126 are refilled with ink after each droplet is ejected. In this regard, each chamber is continuous with a channel 136 that is formed in the barrier layer 128. The channels 136 extend toward an elongated ink feed channel 140 (FIG. 2) that is formed through the substrate. Ink feed channel 140 may be centered between rows of chambers 126 that are located on opposite long sides of the ink feed channel 140, as shown in FIG. 2, according to another embodiment. For one embodiment, the ink feed channel 140 is made after the ink-ejecting components (except for the orifice plate 134) are formed on substrate 125.

The just mentioned components (barrier layer 128, resistors 130, etc.) for ejecting the ink drops are mounted to the top 142 of the substrate 125. For one embodiment, the bottom of the print head may be mounted to an ink reservoir portion of an ink cartridge or ink feed channel 140 may be coupled to a separate (or off-axis) ink reservoir, e.g., by a conduit, at the bottom so that the ink feed channel 140 is in fluid communication with openings to the reservoir. Thus, refill ink flows through the ink feed channel 140 from the bottom toward the top 142 of the substrate 125. The ink then flows across the top 142 (that is, to and through the channels 136 and beneath the orifice plate 134) to fill the chambers 126.

Figure 3A:
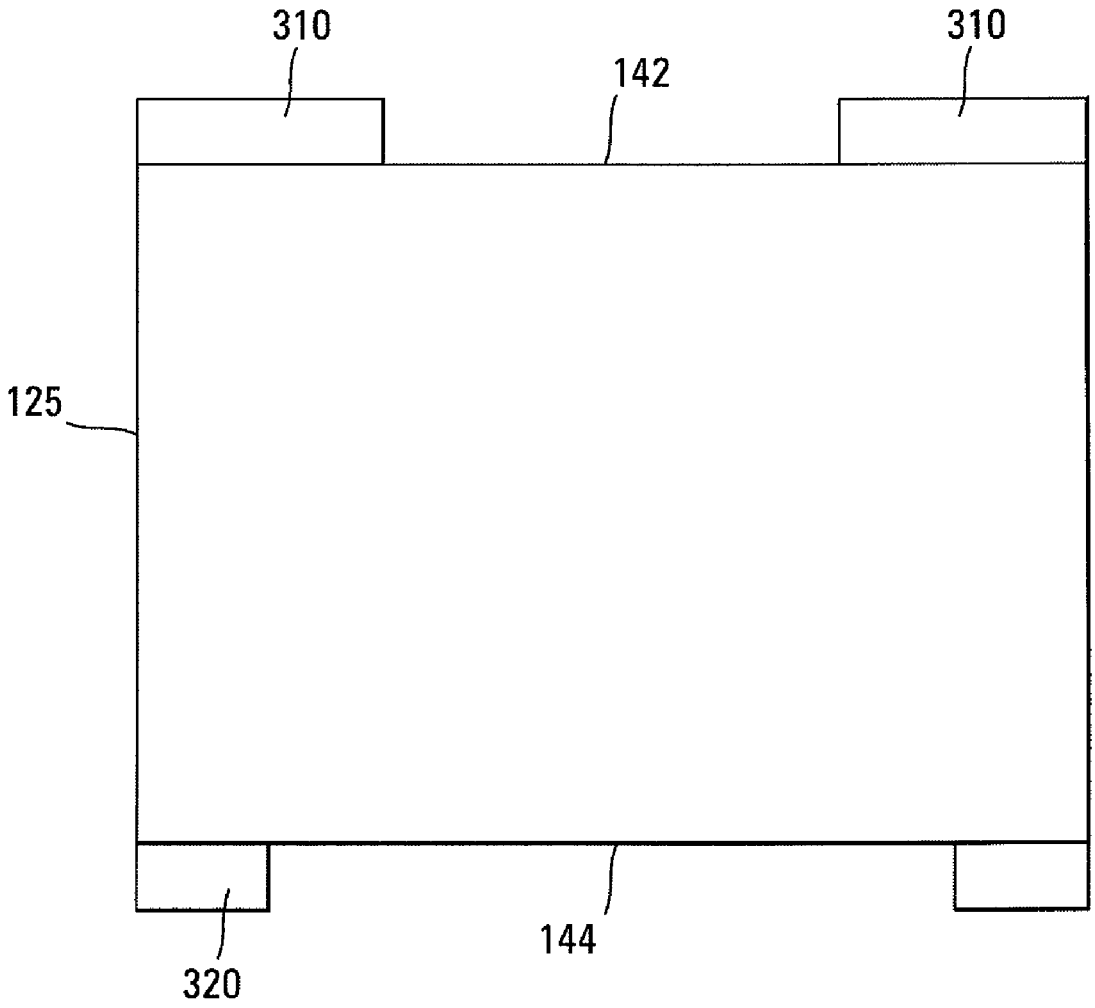
FIGS. 3A-3D are cross-sectional views of a portion of an embodiment of print head substrate during various stages of an embodiment of forming an embodiment of an ink feed channel, according to an embodiment of the disclosure.
Figure 3B:
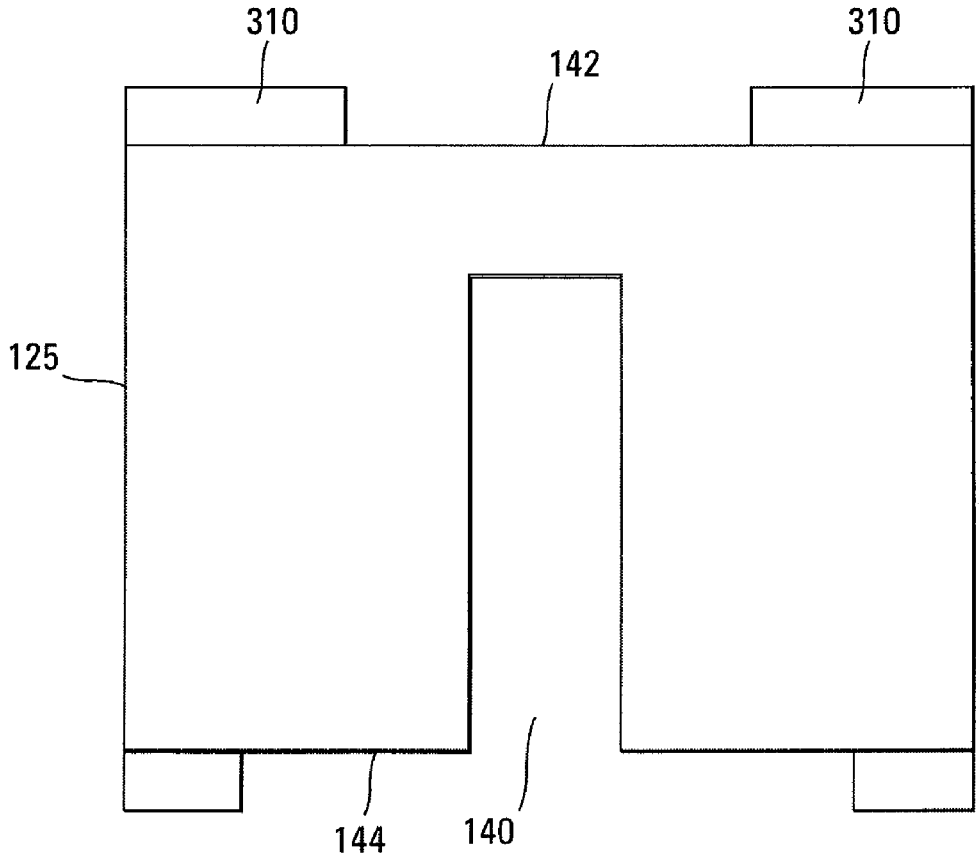

FIGS. 3A-3D are cross-sectional views of a portion of print head substrate 125 (FIGS. 1 and 2) during various stages of the formation of ink feed channel 140, according to another embodiment. The above-described ink ejecting components, such as the barrier layer, resistors, etc., are shown for simplicity as a single layer 310. In FIG. 3A, a dielectric layer 320, such as of silicon dioxide, formed on bottom 144 of the substrate 125 has been patterned and etched to expose a portion bottom 144 of the substrate 125. A portion of ink feed channel 140 is formed in substrate 125 using a light beam, such as a laser beam, in FIG. 3B such that ink feed channel 140 extends partially through substrate 125 from the bottom 144. As used herein the term "light" refers to any applicable wavelength of electromagnetic energy.

Figure 3C:
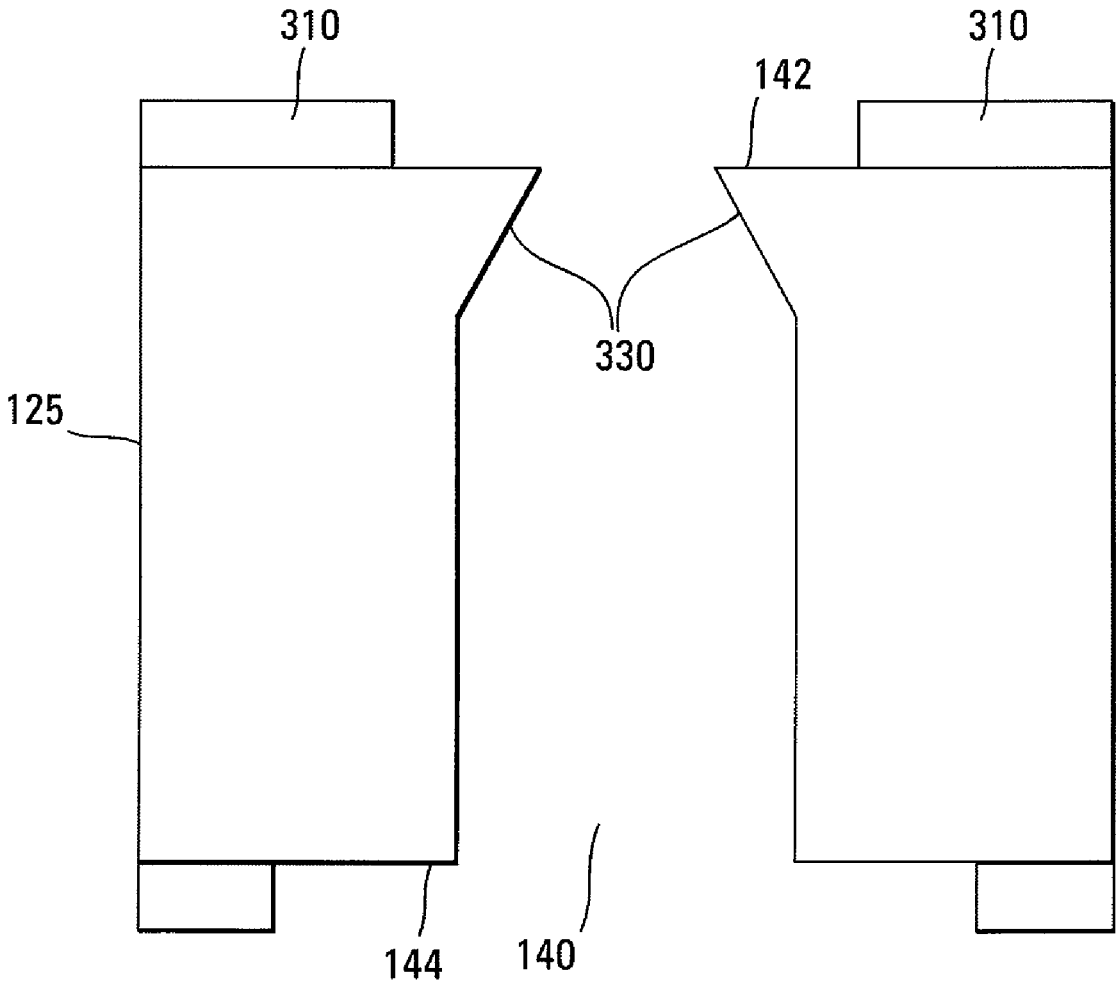

In FIG. 3C, ink feed channel 140 is etched, e.g., using an anisotropic etch, such that ink feed channel 140 extends through top 142. For one embodiment, the etch acts to widen ink feed channel 140 and produces a tapered portion 330 that tapers to top 142, as shown in FIG. 3C. For some embodiments, the etch is a wet etch that includes a clean-up etch, such as a buffered oxide etch for removing any oxides that formed while cutting with the light beam. The clean-up etch is then followed by the anisotropic wet etch that forms the tapered portion 330, e.g., using tetramethyl ammonium hydroxide (TMAH).

It should be noted that using the light beam to cut a portion of the ink feed channel as opposed to etching this portion without the laser acts to limit the size of the ink feed channel, which may be critical for small print heads. Etching the remaining portion to open the ink feed channel to front surface 142 prevents destruction of the ink ejection components formed on front surface 142 that would occur if the light beam was used to open the ink feed channel to front surface 142.

Figure 3D:
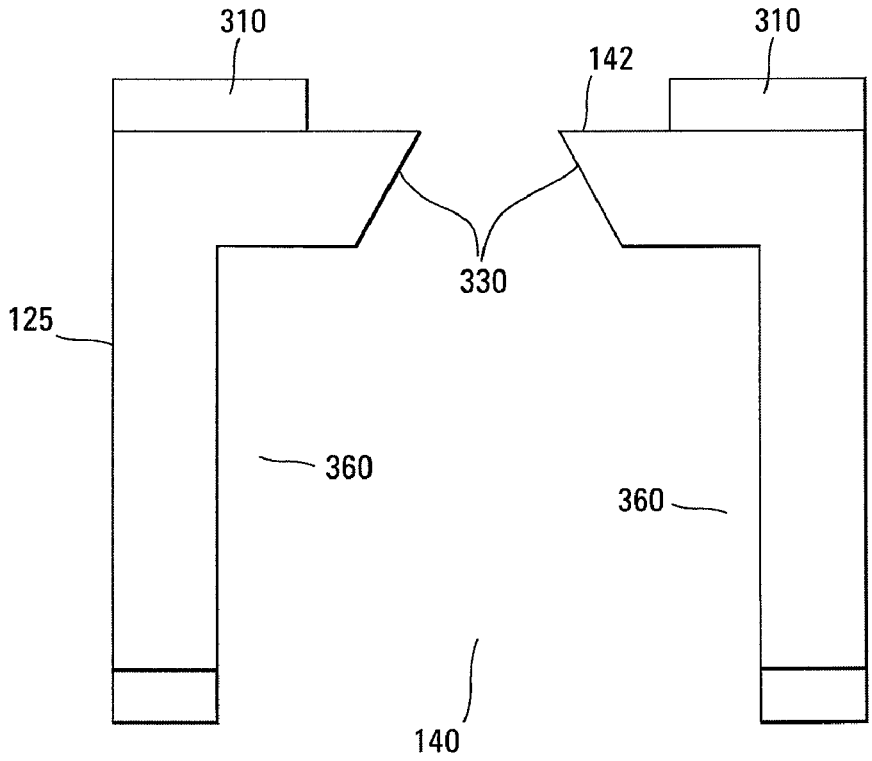
Figure 4:
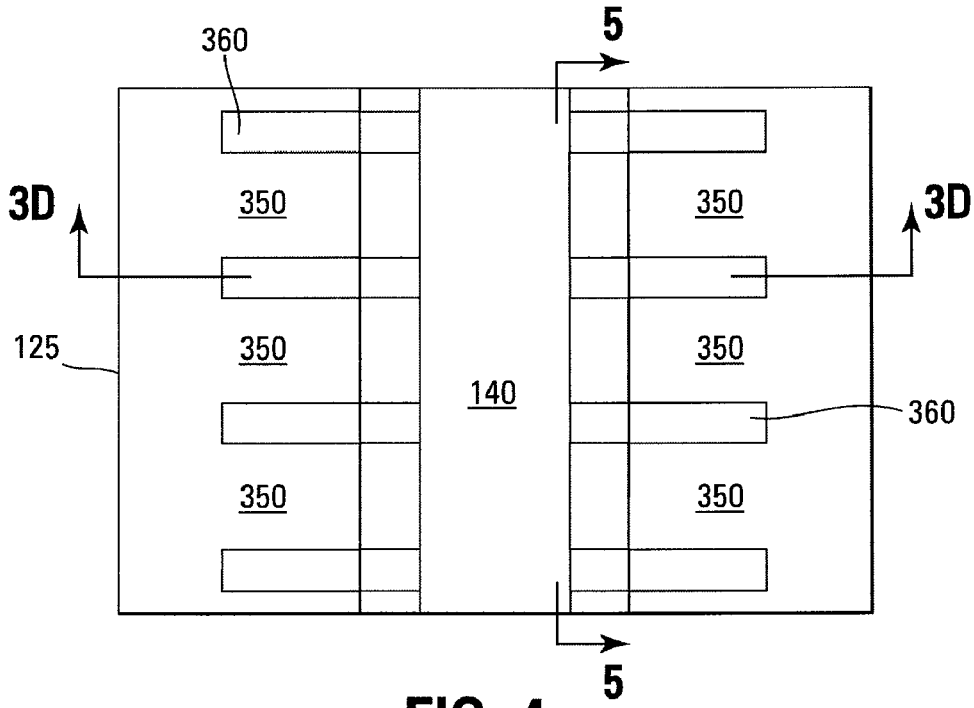
FIG. 4 is a bottom plan view of an embodiment of a print head substrate, according to an embodiment of the disclosure.

The light beam is then used to create fins 350 in the substrate 125, as shown in FIG. 4, by cutting a plurality of slots 360 extending from and fluidly coupled to ink feed channel 140. Note that FIG. 3D is a cross section viewed along line 3D-3D of FIG. 4 and thus illustrates that the laser widens the cross-section at selected locations along a length of ink feed channel 140 to form a pair of opposing slots 360, for one embodiment. Also note that a fin 350 of substrate material is formed adjacent slots 360. For one embodiment, the clean-up etch described above is performed to clean up slots 360 after their formation. Note that slots 360, and thus fins 350, extend continuously from the bottom to up to about or to just before taper 330, as illustrated in FIG. 5 a perspective view taken along line 5-5 of FIG. 4.

Figure 6:
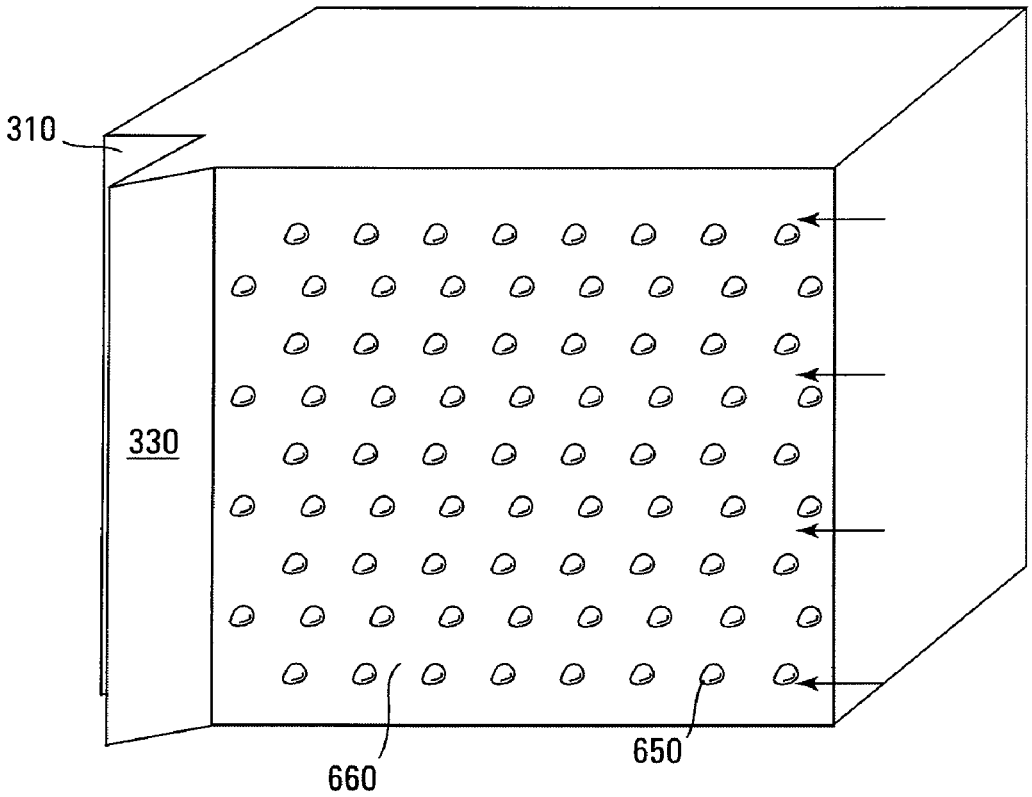
FIG. 6 is a perspective view of an embodiment of an interior wall of an ink-feed slot, according to another embodiment of the disclosure.

For another embodiment, the light beam may be used after the anisotropic wet etch to form roughness elements 650 in the interior wall of ink feed channel 140 that act to increase the surface area of the interior wall of ink feed channel 140, as is illustrated in FIG. 6, a perspective view of the interior wall of ink feed channel 140. This may be followed by a buffered oxide etch for oxide removal. Roughness elements 650 may have a number of shapes, such as square, round, oval, rectangular or may be cylindrical pin fins extending from the surface, etc.

For another embodiment, slots 360 or spaces 660 between roughness elements 650 are formed by spraying resist in the ink feed channel 140 of the configuration of FIG. 3C after performing the anisotropic etch, using the light beam to pattern the resist, and removing exposed substrate material, e.g., using an isotropic wet etch, to form slots 360 or spaces 660.

Figure 5:
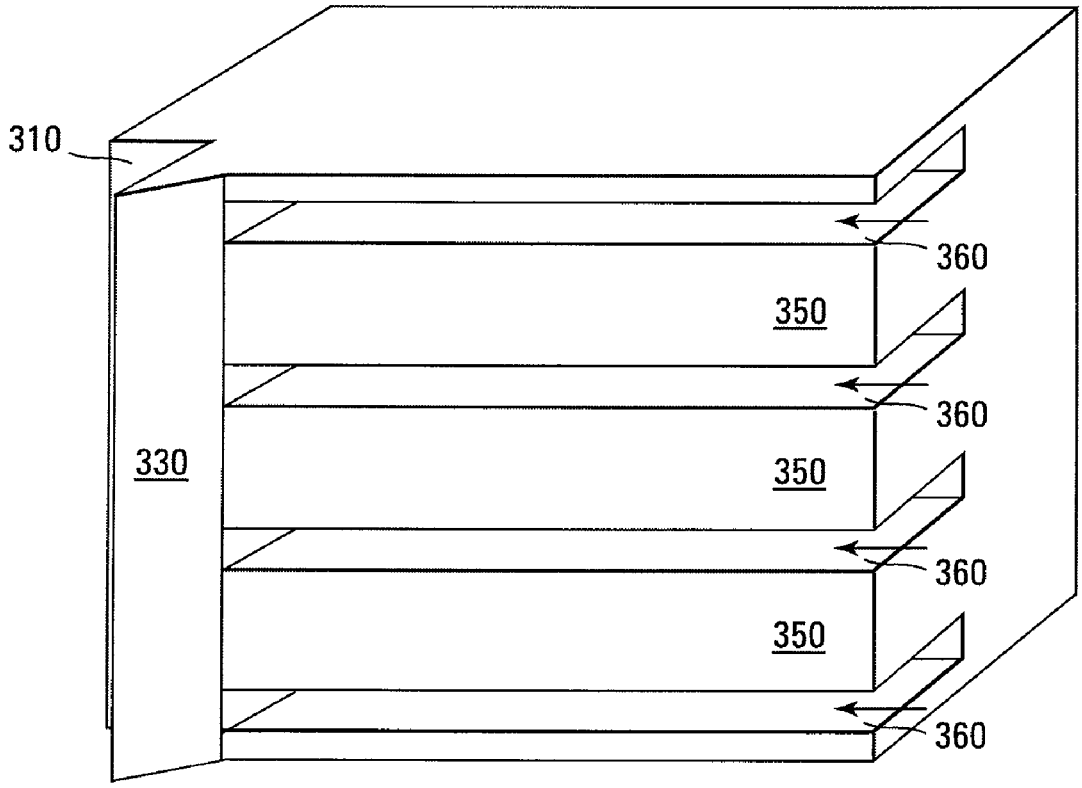
FIG. 5 is a perspective view taken along line 5-5 of FIG. 4, according to an embodiment of the disclosure.

In operation, ink flows from the bottom to the top of the print head, through ink feed channel 140 and slots 360 or spaces 660, as illustrated by the arrows in FIGS. 5 and 6. Fins 350 or roughness elements 650 are substantially perpendicular to the interior walls of ink feed channel 140 and are substantially perpendicular to the ink flow, as shown in FIGS. 5 and 6. As the ink flows, the resistors of layer 310 add heat to substrate 125. The heat is conducted toward ink feed channel 140 and fins 350 or roughness elements 650 and is in turn convected away by the ink flow. Note that fins 350 of FIGS. 4 and 5 and the roughness elements 650 of FIG. 6 increase the area available for heat flow to the ink and thus act to increase heat transfer to the ink flow and thus act to reduce the temperature of substrate 125.

Figure 7:
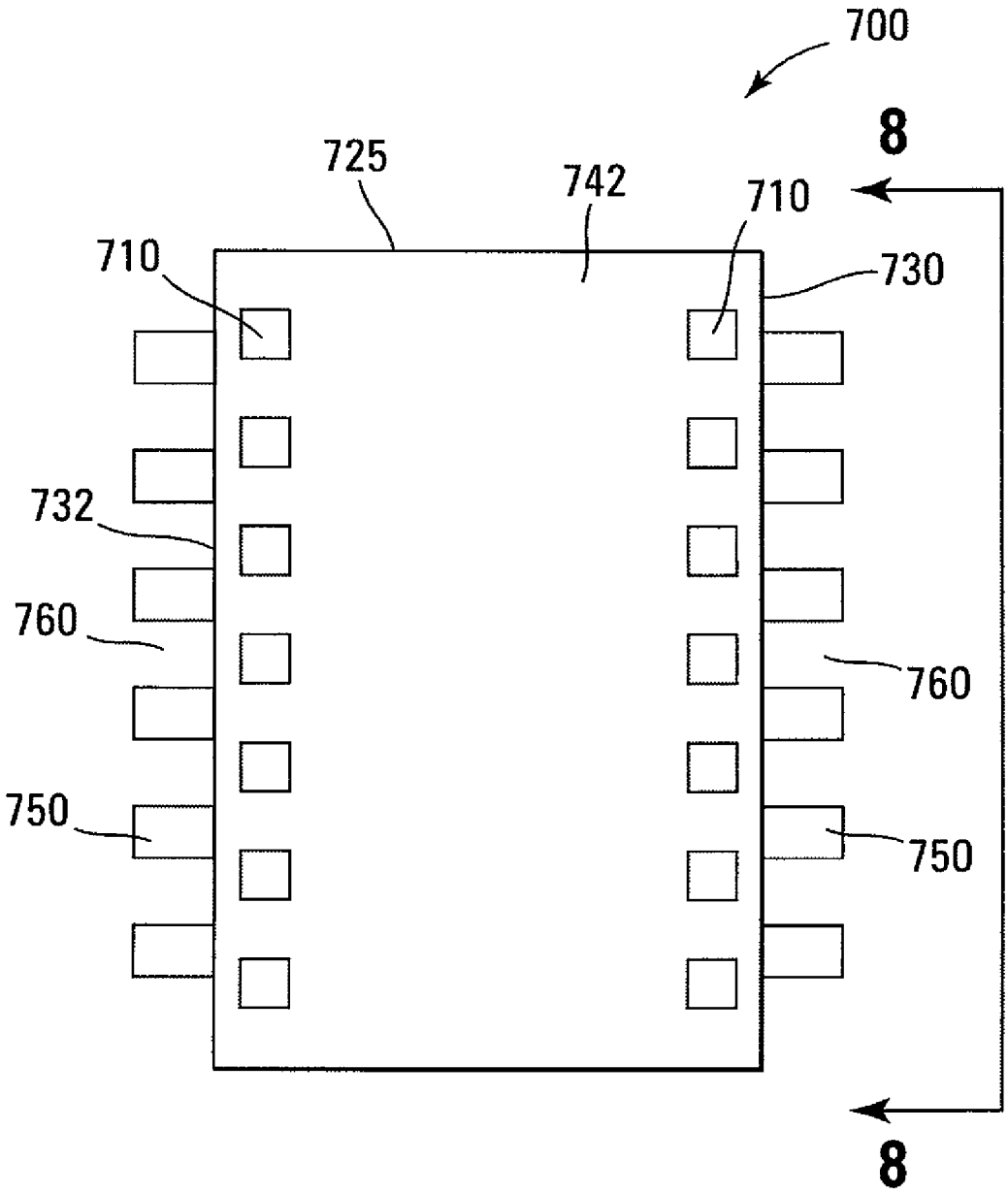
FIG. 7 illustrates a top plan view of an embodiment of a print head, according to an embodiment of the disclosure.

FIG. 7 illustrates a top plan view of a top 742 of a substrate 725 of a print head 700, according to an embodiment. Print head 700 includes resistors 710 formed on a substrate 725. For one embodiment, resistors 710 are formed adjacent opposing external sides 730 and 732 of substrate 725. Resistors 710 are configured and function similarly to resistors 130 of FIGS. 1 and 2, with the exception that they are located adjacent opposing external sides 730 and 732 of the substrate rather than adjacent an internal channel passing through the substrate, as shown in FIG. 2.

Figure 8:
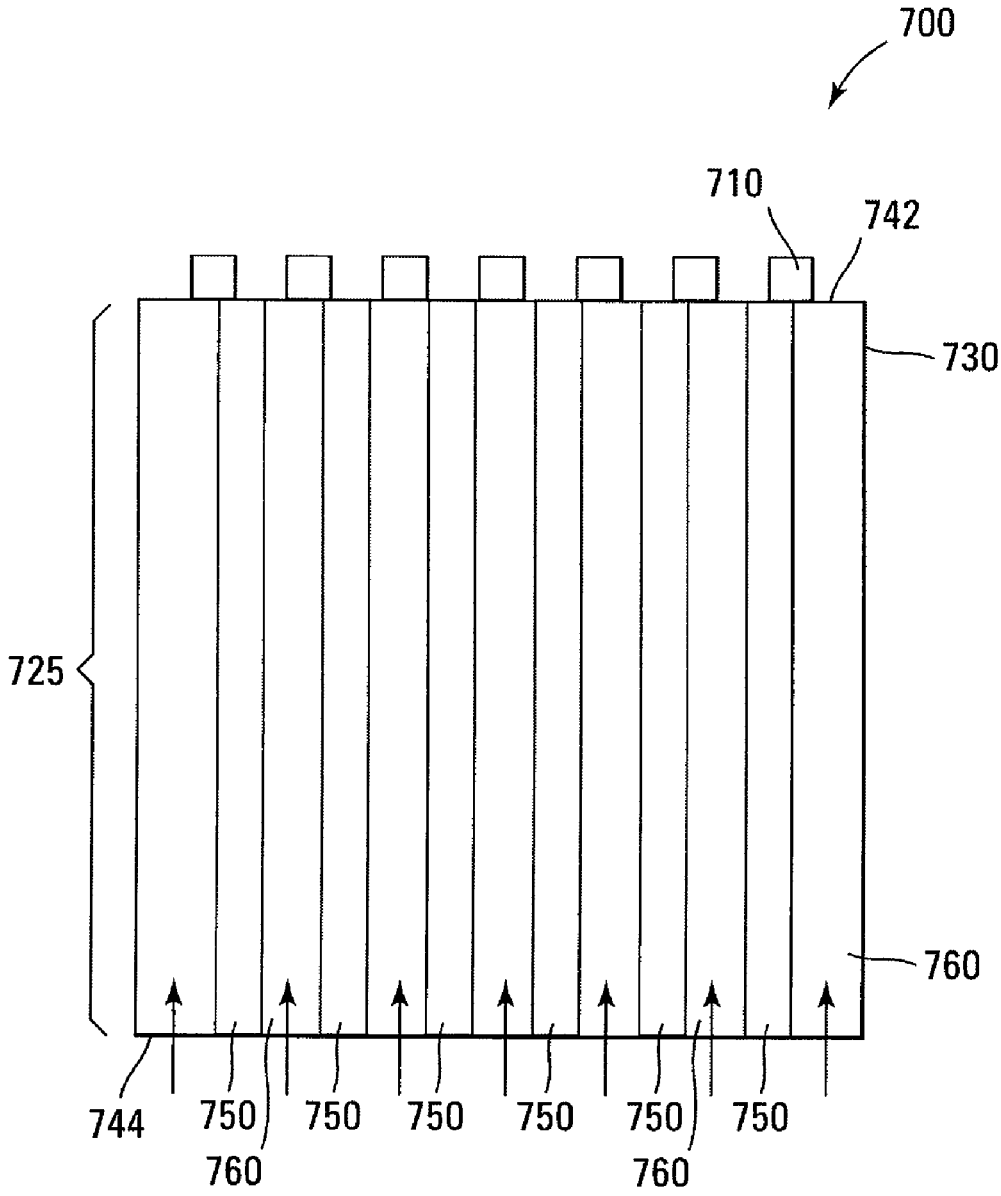
FIG. 8 is a view taken along line 8-8 of FIG. 7, according to an embodiment of the disclosure.

A plurality of extended surface elements 750, such as fins, discrete roughness elements, e.g., pin fins extending from the surface, or the like, is formed on each of sides 730 and 732. For one embodiment, extended surface elements 750 are continuous fins that extend from top 742 to a bottom 744 of substrate 725, as shown in FIG. 8, a view taken along line 8-8 of FIG. 7. For some embodiments, the light beam is used to create extended surface elements 750 in substrate 725 by cutting a plurality of slots 760 in each of sides 730 and 732, as shown in FIGS. 7 and 8. For one embodiment, the clean-up etch described above is performed to clean up slots 760 after their formation. For other embodiments, the light beam is used to form the discrete roughness elements in each of sides 730 and 732.

For one embodiment, print head 700 is configured so that ink flows along sides 730 and 732 from bottom 744 to top 742 substantially parallel to extended surface elements 750, as indicated by the arrows of FIG. 8. The ink is then directed to resistors 710, e.g., by channels similar to channel 136 of FIG. 1.

CONCLUSION

Although specific embodiments have been illustrated and described herein it is manifestly intended that the scope of the claimed subject matter be limited only by the following claims and equivalents thereof.

What is claimed is:

1. A print head comprising:
   - a substrate having an ink feed channel passing therethrough and having first and second surfaces that are substantially parallel to each other and that face away from each other;
   - ink injection components formed on the first surface; and
   - a plurality of extended surface elements extending from one or more interior sidewalls of the ink feed channel into the ink teed channel;
   - wherein a portion of the second surface forms an end surface of each of the extended surface elements;
   - wherein each of the extended surface elements extends from the second surface in a direction along file ink feed channel and terminates within the substrate before the first surface; and
   - wherein the ink feed channel is tapered from where the extended surface elements terminate to where the ink feed channel opens at the first surface so that the ink feed channel is narrower at the first surface than where the extended surface elements terminate.

2. The print head of claim 1 further comprises a plurality of resistors fluidly coupled to the ink feed channel.

3. The print head of claim 2 further comprises an orifice fluidly coupled to each resistor.

4. A print head comprising:
   - a means for conducting heat from one or more resistors formed on a first surface of the print head to an ink feed channel passing from a second surface of the print head through the first surface, the second surface substantially parallel to the first surface and facing away from the first surface; and a means for extending the surface area of a portion of the heat conducting means that is wetted by ink flowing through the ink feed channel, the surface area extending means extending from an interior sidewall of the ink feed channel, a portion of the second surface forming an end surface of the surface area extending means so that the end surface of the surface area extending means is substantially parallel to and facing away from the first surface;

wherein, the surface area extending means extends from the second surface in a direction along the ink feed channel and terminates within the ink feed substrate before the first surface, wherein the ink feed channel is tapered from where extending means terminate to where the ink feed channel opens at the first surface so that the ink feed channel is narrower at the first surface than where extending means terminate.

5. The print head of claim 4, wherein the surface area extending means extends from the interior sidewall of the ink feed channel in a direction that is substantially perpendicular to a direction of the ink flow.

6. A method of cooling a print head, comprising:

conducting heal from one or more resistors formed on a first surface of a substrate of the print head through the substrate of the print head and into one or more extended surface elements extending from an interior sidewall of an ink feed channel passing from a second surface of the substrate through the first surface, the second surface substantially parallel to the first surface and facing away from the first surface, a portion of the second surface forming an end surface of each of the one or more emended surface elements so that the end surface of each of the one or more extended surface elements is substantially parallel to and facing away from the first surface; and convecting the heat from the one or more extended surface elements into ink as it flows through the channel and over the one or more extended surface elements;

wherein, each of the extended surface elements extends from the second surface of the print head and terminates within the substrate before the first surface, wherein the ink feed channel is tapered from where the extended surface elements terminate to where the ink feed channel opens at the first surface so that the ink feed channel is narrower at the first surface than where the extended surface elements terminate.

7. The method of claim 6, wherein the ink flows substantially parallel to each of the extended surface elements.

* * * * *

UNITED STATES PATENT AND TRADEMARK OFFICE

CERTIFICATE OF CORRECTION

PATENT NO. : 7,959,264 B2
APPLICATION NO. : 12/260326
DATED : June 14, 2011
INVENTOR(S) : Dustin W. Blair et al.

It is certified that error appears in the above-identified patent and that said Letters Patent is hereby corrected as shown below:

In column 4, line 48, in Claim 1, delete “teed” and insert -- feed --, therefor.

In column 4, line 52, in Claim 1, after “along” delete “file” and insert -- the --, therefor.

In column 5, line 14, in Claim 4, delete “wherein,” and insert -- wherein --, therefor.

In column 6, line 2, in Claim 6, delete “heal” and insert -- heat --, therefor.

In column 6, line 11, in Claim 6, delete “emended” and insert -- extended --, therefor.

In column 6, line 17, in Claim 6, delete “wherein,” and insert -- wherein --, therefor.

Signed and Sealed this
Third Day of January, 2012

David J. Kappos

David J. Kappos
*Director of the United States Patent and Trademark Office*